US005158614A

United States Patent [19]

Takeuchi

[11] Patent Number: 5,158,614

[45] Date of Patent: Oct. 27, 1992

[54] VERTICALLY-RECIPROCATING COATING APPARATUS

[75] Inventor: Tohru Takeuchi, Yokohama, Japan

[73] Assignee: Kansai Paint Co., Ltd., Hyogo, Japan

[21] Appl. No.: 813,018

[22] Filed: Dec. 24, 1991

[30] Foreign Application Priority Data

Jan. 8, 1991 [JP] Japan ..... 3-11518

[51] Int. Cl.[5] ..... B05B 13/00; B05B 15/08

[52] U.S. Cl. ..... 118/323; 239/281; 239/283

[58] Field of Search ..... 118/323, 631, 321; 239/281, 283

[56] References Cited

U.S. PATENT DOCUMENTS 4,239,431 12/1980 Davini ..... 118/323
4,532,148 7/1985 Vecellio ..... 454/58
4,704,985 11/1987 Rubinstein ..... 118/323

*Primary Examiner*—Michael G. Wityshyn
*Assistant Examiner*—Charles K. Friedman
*Attorney, Agent, or Firm*—Wenderoth, Lind & Ponack

[57] ABSTRACT

A vertically-reciprocating coating apparatus is constructed by means of setting one end of a first arm on a first pivot, setting one end of a second arm on a second pivot connected with a drive which moves on a linear rail, setting the other end of the first arm on a third pivot provided in a middle part of the second arm, and connecting a coater with a fourth pivot provided at a free end of the second arm.

1 Claim, 2 Drawing Sheets

VERTICALLY-RECIPROCATING COATING APPARATUS

FIELD OF THE INVENTION

The present invention relates to a vertically-reciprocating coating apparatus in which a coater is caused to vertically reciprocate so that, for example, objects to be coated are subjected to coating after being carried close to the coater.

BACKGROUND AND PRIOR ART OF THE INVENTION

In the vertically-reciprocating coating apparatus, the coater is caused to vertically reciprocate and a containing material is sprayed with a predetermined spray pattern from the coater upon objects carried close to the coater by a conveyor. If an object (excluding an inner wall of a booth) other than the objects to be coated is present in a spraying direction of the coater in this vertically-reciprocating coating apparatus, said object is contaminated; thus, it has been made necessary to attach a drive for reciprocating the coater, etc., to an upper or lower portion of the coater. That is, in a conventional vertically-reciprocating coating apparatus, the coater is mounted on a shaft which reciprocates in a vertical direction, and is caused to vertically-reciprocate with a reciprocating motion of this shaft.

This coating method requires a reciprocating drive having a height about 1.2 to 1.5 times greater than an effective range of a vertical reciprocation of the coater, and it has been made necessary to secure the drive on top of a booth or under the floor of the booth. Because of this, there have been problems such as the need of furnishing a building for installing the vertically-reciprocating coating apparatus with a particularly high ceiling, the difficulty of installing said apparatus in a low-ceilinged building, etc. There is also a method of installing said apparatus by means of digging a pit under the floor of the booth, but in this method, the installation place is limited and a problem such as an increase in cost arises. Furthermore, there have been some problems with the conventional vertically-reciprocating coating apparatus, such as the liability of the drive and other parts to get contaminated, the difficulty of maintaining them in good condition, etc.

Particularly, said apparatus has the disadvantage that the drive is contaminated with the spray pattern of the coater and that the coater cannot have a wide effective range of its reciprocation.

SUMMARY OF THE INVENTION

According to the present invention, the above problems can be solved by providing a vertically-reciprocating coating apparatus comprising a first pivot placed in a fixed position; a first arm supported by the first pivot; a drive which moves on a horizontal linear rail; a second pivot which is connected with the drive and caused to linearly move on the same horizontal level with the first pivot; a second arm supported by the second pivot; a third pivot provided in a middle part of the second arm; a fourth pivot provided at an end of the second arm; and a coater supported by the fourth pivot, said first arm being supported by the third pivot, said third pivot being on a straight line connecting the second and fourth pivots, and the distance between said first pivot and said third pivot being half the distance between the second pivot and the fourth pivot. When the drive is caused to move on the horizontal linear rail, the fourth pivot attached to the second arm is caused to vertically move with the motion of the drive, whereupon the coater is subjected to a vertical motion.

DESCRIPTION OF THE EXAMPLE EMBODIMENT

Next, a vertically-reciprocating coating apparatus in accordance with an embodiment of the present invention will be explained by reference to the attached drawings.

Figure 1:
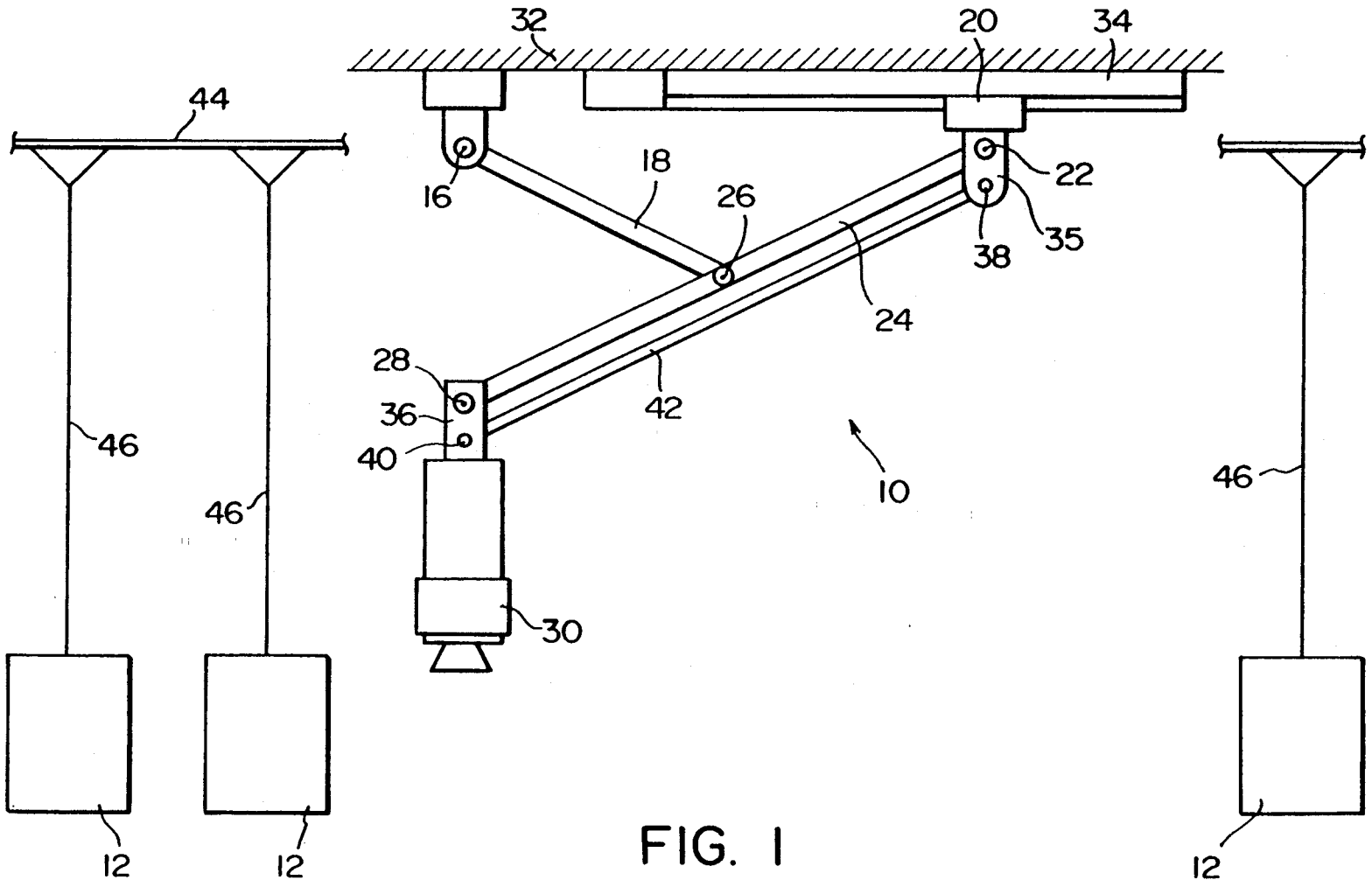
FIG. 1 shows a side view of a vertically-reciprocating coating apparatus in accordance with an embodiment of the present invention, and a side view of objects to be coated by said apparatus.

FIG. 1 shows a vertically-reciprocating coating apparatus 10 in accordance with an embodiment of the present invention, objects 12 which are subjected to coating by this vertically-reciprocating coating apparatus, and supporting means adapted to support the objects to be coated.

This vertically-reciprocating coating apparatus 10 comprises a first pivot 16, a first arm 18 pivotably supported by the first pivot 16, a drive 20 which moves on a horizontal linear rail, a second pivot 22 connected with the drive 20, a second arm 24 pivotably supported by the second pivot, a third pivot 26 provided in a middle pat of the second arm 24, a fourth pivot 28 provided at one end of the second arm, and a coater 30 pivotably supported by the fourth pivot.

The first pivot 16 is fixed to, for example, a frame 32 for the ceiling of a booth.

One end of the first arm 18 is supported by the first pivot 16 such that said arm is capable of pivoting along any plane parallel with the sheet of FIG. 1.

The drive 20 is supported by, for example, a horizontal linear rail 34 fixed to the frame 32 for the ceiling of the booth, and reciprocates along this rail at a controlled rate. This drive 20 can be constructed by means of using, for example, a single axis robot.

The second pivot 22 is connected to the drive 20 through the aid of a first fixture 35. A straight line connecting the center of the first pivot 16 and the center of the second pivot 22 is parallel with a straight moving direction of the drive 20 determined by the rail 34.

The second arm 24 is pivotably supported by the second pivot 22. The third pivot 26 is provided in a middle part of the second arm 24, and the fourth pivot 28 is provided at a free end of the second arm 24. The other end of the first arm 18 is pivotably connected to the second arm 24 through the third pivot 26. The coater 30 is connected to the fourth pivot through the aid of a second fixture 36. In this way, the coater 30 is pivotably connected with the second arm 24. As for coaters 30, a coater equipped with spray gun, a rotary spray head and the like can be used.

The length L of a line connecting the center of the second pivot 22 and the center of the fourth pivot 28 is twice the length of a line connecting the center of the first pivot 16 and the center of the third pivot 26, and the center of the third pivot 26 is located in the middle of the line connecting the center of the second pivot 22 and the center of the fourth pivot 28.

Because of the above structure, when the drive 20 is caused to move along the rail 34, the coater 30 moves along a vertically-extending straight line connecting the first pivot 16 and the fourth pivot 28, with the motion of the drive.

Furthermore, the first fixture 35 and the second fixture 36 are provided with a fifth pivot 38 and a sixth pivot 40, respectively, and an auxiliary arm 42 is pivotably supported by those fifth and sixth pivots 38 and 40.

The second and fifth pivots 22 and 38 provided in the first fixture 35 and the fourth and sixth pivots 28 and 40 provided in the second fixture 36 form a parallelogram. A line connecting the second and fifth pivots 22 and 38 provided in the first fixture 35 extends in a vertical direction, and a line connecting the fourth and sixth pivots 28 and 40 provided in the second fixture 36 extends in a vertical direction.

Since the apparatus is constructed as stated above, the direction of the line connecting the fourth and sixth pivots 28 and 40 provided in the second fixture 36 is kept vertical and the moving direction of the coater 30 attached to the second fixture 36 is kept unchanged, regardless of a vertical motion of the second arm 24.

As shown in FIG. 1, the objects 12 to be coated by the vertically-reciprocating coating apparatus 10 are supported by a conveyor 44 and hangers 46 being well-known supporting means, and are caused to move at a uniform rate.

Figure 2:
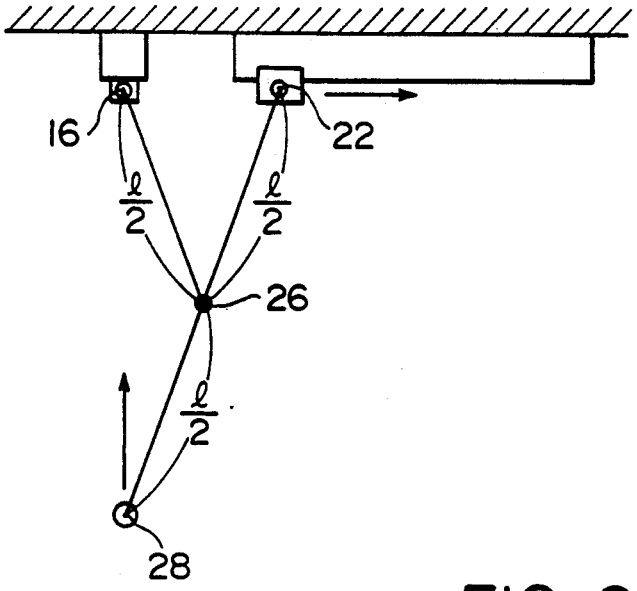
FIG. 2 is a simplified drawing for explaining the operation of the vertically-reciprocating coating apparatus of FIG. 1.
Figure 3:
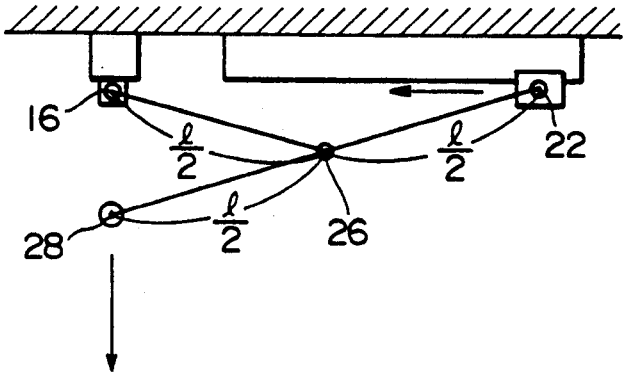
FIG. 3 is another simplified drawing for explaining the operation of the vertically-reciprocating coating apparatus of FIG. 1.

FIGS. 2 and 3 respectively show an example of the disportion of pivots wherein the second pivot 22 is in its leftmost position, and another example of said disposition wherein the second pivot 22 is in its right-most position. As is clear from those drawings, the fourth pivot 28 to be connected with the coater is always located at the lowest one of the parts constituting the present vertically-reciprocating coating apparatus, so as to minimize the contamination of the other parts with the spray pattern of the coater to be connected with this fourth pivot 28.

Moreover, when the drive 20 is caused to reciprocate in a horizontal direction at a uniform rate, the coater 30 moves in a vertical direction at a non-uniform rate. If it is desired that the coater 30 should be moved in a vertical direction at a uniform rate, the drive 20 can be controlled so as to move at a non-uniform rate with a uniform motion of the coater. As for such drives 20 that move at a non-uniform rate, it is desirable to use a drive in which the positions and speeds of a single axis robot and other parts can be controlled.

As stated above, according to the present invention, it is possible to provide a vertically-reciprocating coating apparatus wherein a drive is not contaminated with a spray pattern of a coater and wherein the coater is allowed to have a wide effective range of its reciprocation.

What is claimed is:

1. A vertically-reciprocating coating apparatus comprising:

a first pivot placed in a fixed position;

a first arm supported by the first pivot;

a drive which moves on a horizontal linear rail;

a second pivot which is connected with the drive and caused to linearly move on the same horizontal level with the first pivot;

a second arm supported by the second pivot;

third pivot provided in a middle part of the second arm;

a fourth pivot provided at an end of the second arm; and a coater supported by the fourth pivot, said first arm being supported by the third pivot, said third pivot being on a straight line connecting the second and fourth pivots, and the distance between said first pivot and said third pivot being half the distance between the second pivot and the fourth pivot.

* * * * *